US012543902B2

(12) United States Patent
Fernandes Godoy Almeida

(10) Patent No.: US 12,543,902 B2
(45) Date of Patent: Feb. 10, 2026

(54) ELECTRICAL/ELECTRONIC DEVICE FOR AUTOMATIC OPERATION OF A TOILET LID

(71) Applicant: Gustavo Fernandes Godoy Almeida, Recife (BR)

(72) Inventor: Gustavo Fernandes Godoy Almeida, Recife (BR)

( * ) Notice: Subject to any disclaimer, the term of this patent is extended or adjusted under 35 U.S.C. 154(b) by 36 days.

(21) Appl. No.: 18/039,715

(22) PCT Filed: Oct. 21, 2021

(86) PCT No.: PCT/BR2021/050461
§ 371 (c)(1),
(2) Date: May 31, 2023

(87) PCT Pub. No.: WO2022/032369
PCT Pub. Date: Feb. 17, 2022

(65) Prior Publication Data

US 2024/0108182 A1 Apr. 4, 2024

(30) Foreign Application Priority Data

May 14, 2021 (BR) ..... 20 2021 009473 2

(51) Int. Cl.
*A47K 13/10* (2006.01)

(52) U.S. Cl.
CPC ..... *A47K 13/10* (2013.01)

(58) Field of Classification Search
CPC ..... A47K 13/10; A47K 13/26
See application file for complete search history.

(56) References Cited

U.S. PATENT DOCUMENTS 5,878,444 A 3/1999 Convoy
6,321,393 B1 11/2001 Jones
(Continued)

FOREIGN PATENT DOCUMENTS

KR 101053150 B1 * 3/2009
KR 101906904 B1 10/2018

OTHER PUBLICATIONS

Almeida, G., PCT/BR2021/050461, International Search Report, Dec. 30, 2021, 7 pages.
(Continued)

*Primary Examiner* — Christine J Skubinna
(74) *Attorney, Agent, or Firm* — SHUTTLEWORTH & INGERSOLL, PLC; Jason R. Sytsma

(57) ABSTRACT

The present utility model, entitled electrical/electronic device for the automatic operation of a toilet lid (1), has been developed for automatically raising and lowering a toilet lid without manual contact by means of the incorporation of an electrical/electronic component comprising an adjustable fastening base (2) compatible with any toilet manufactured in accordance with Brazilian standards; a lid actuating arm (3); a seat actuating arm (4); an arm actuating assembly (5) comprising an electric motor and a motor and gear reduction assembly (6), batteries and a presence sensor (7) for actuation. Actuation is carried out by bringing a foot (right and/or left, or any other walking aid) into proximity with the detection area of the sensor (8), which will identify the action required (raising/lowering the lid and seat), thus avoiding any handling of parts of the toilet by the user.

12 Claims, 15 Drawing Sheets

(56) References Cited

U.S. PATENT DOCUMENTS

Figure 1:
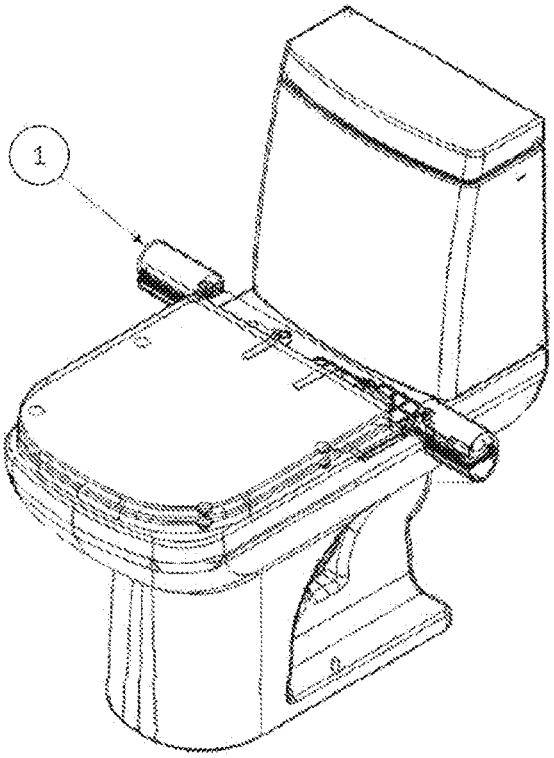

| | | | | |
|---|---|---|---|---|
| 7,788,741 | B2 | 9/2010 | Lohss | |
| 7,987,528 | B1 * | 8/2011 | Ross | A47K 13/10 4/246.3 |
| 8,910,320 | B2 | 12/2014 | Stauber et al. | |
| 10,743,729 | B1 * | 8/2020 | Tendeng | A47K 13/10 |
| 10,791,888 | B1 | 10/2020 | Doctor | |
| 2010/0083431 | A1 * | 4/2010 | Hallett | A47K 13/10 4/246.1 |
| 2014/0373263 | A1 * | 12/2014 | Plate | E03D 9/00 4/300 |
| 2015/0272409 | A1 * | 10/2015 | Cayabyab | A47K 13/10 4/246.3 |
| 2018/0360277 | A1 | 12/2018 | Henderson et al. | |

OTHER PUBLICATIONS

Almeida, G., PCT/BR2021/050461, Written Opinion, Dec. 30, 2021, 11 pages.

* cited by examiner

ELECTRICAL/ELECTRONIC DEVICE FOR AUTOMATIC OPERATION OF A TOILET LID

The present Utility Model Patent named ELECTRO-ELECTRONIC DEVICE FOR TOILET LID AUTOMATION (1), which was developed for automation of the operation of lifting and lowering the toilet lid without manual contact by incorporating a device composed of adjustable fixing base (2); lid drive arm (3) seat drive arm (13); arm drive assembly (5) consisting of an electric motor and a gear motor assembly (6), batteries and presence sensor for the driving (7). The activation of the device occurs by approaching one of the feet (right and left) or any other locomotion assistance object to the device (8), which identifies the necessary action, preventing physical contact of the user with the lid and the seat of the toilet, preventing contamination of the users hands.

1. INTRODUCTION

This Utility Model Patent specification refers to an ELECTRO-ELECTRONIC DEVICE FOR TOILET LID AUTOMATION consisting of a fixation base adjustable to various types of toilets in accordance with Brazilian Standards NBR 15097—Toilet made of ceramic material and NBR 15099—Toilets made of ceramic material—Standard dimensions, which is fixed using the same seat and lid fixing screws and positioning the respective arms on the seat and on the toilet lid.

2. APPLICATION FIELD

The application of the ELECTRO-ELECTRONIC DEVICE FOR TOILET LID AUTOMATION focuses on hydraulic facilities (sanitary hydraulic application field) for both residential and industrial applications, health (hospitals, emergency rooms, clinics), public (public offices, government departments, etc.), private (hotels, stores, businesses, offices, gas stations, workshops, etc.) and other places where there are facilities with toilets built and installed in accordance with the Brazilian standards in force.

3. PURPOSES

As the main purpose of the ELECTRO-ELECTRONIC DEVICE FOR TOILET LID AUTOMATION, hygiene must be the first highlight, since, when it is used, manual contact with the lid and seat of the vessel is not necessary, thus preventing contamination with bacteria and viruses that might be present on these appliances.

In addition, the practicality of its activation is another plus, due to the simple fact that the activation occurs by approaching the sensor with the right or left foot, or any object of locomotion support, the user not having to apply any pressure or having any contact with pedals, buttons, etc.

Based on the reading made by the sensor incorporated to the ELECTRO-ELECTRONIC DEVICE FOR TOILET LID AUTOMATION, the motor assembly that lifts the toilet lid is activated and, by means of a new activation, it then lifts the seat (it can also be activated only to lift the lid and the seat concomitantly), enabling the use of the toilet without manual contact.

4. PRIOR ART 4.1 EXISTING PROBLEMS

In accordance with the general knowledge of toilet users, in all uses, in private and/or public locations, it is necessary to handle the lid and the seat, either to lower or lift them. Considering the current prior art of toilets found in Brazil, this operation is done manually, and there is contact with the seat and the lid that, as they are placed in environments susceptible to bacteria proliferation, they may act as contaminating agents.

This problem becomes even greater in hospital and health-care environments in general where, due to the very characteristics of the environment, if all the steps of hygiene and cleaning are not fulfilled, the toilet may, in addition to bacteria, contain viruses and fungi commonly found in contaminated environments (gastrointestinal viruses, enteric pathogens, cutaneous pathogens and dermatophytic fungi, and residual fungi), also specific contaminants due to the presence of patients in various immunocompromising conditions, such as: *Klebsiella pneumoniae, Staphylococcus aureus; Pseudomonas aeruginosa; Staphylococcus epidermidis* in strains found in nature and in antibiotic-resistant strains, which makes the 30 questions related to the handling of any item susceptible to contamination, a vector for the spreading of infections.

4.2 PATENT BACKGROUND

In order to manufacture and place on the market a product with unique characteristics, a prior art research was made in the INPI Database, and the following documents were found to be closer to the object of the claim:

- MU 8801675-7 U2 filed on Jul. 28, 2008, named "DEVICE FOR LIFTING THE SEAT AND THE TOILET LID", referring to a device for lifting the seat and toilet lid, which aims to maintain the cleanliness and hygiene of the seats and covers, through a practical and hygienic process of keeping them in the correct position (raised or lowered), according to its use and the user's gender. This lets them be lifted without the aid of hands, but based on the foot pressure on a pedal, which lifts the seat or the cover/seat assembly, through a tilting lever arranged at the bottom of the seat . . . .
- PI 0802265-8 filed on Jul. 18, 2008, named "TOILET LID LIFTER", which refers to a toilet lid lifter that consists of a lifter, an arm piece that is fixed by a screw to the toilet lid, a piston piece that joins the arm piece and the lever pieces that are joined by a pin to a piston piece, and a union piece that is fixed to lever pieces, which are joined to an angle bar piece that will also be fixed to the lever pieces . . . .
- BR 20 2013 004644-8 filed on Feb. 27, 2013, named "HANDLE FOR TOILET SEAT", which refers to a handle, consisting of any anatomical format material to be fixed by means of adhesives to the toilet seat, of any shape and size, for the purpose of lifting or lowering the respective toilet seat in order to use it in both existing and customary ways, the user not needing to touch the toilet seat, making such movements hygienic . . . .
- BR 20 2016 021754 2 U2 filed on Sep. 22, 2016, named "DEVICE FOR LIFTING AND LOWERING THE TOILET LID", which refers to a mechanical device for lifting and lowering the toilet lid by coupling the device to the left or right side of the toilet, characterized by being driven by pedals and consisting of fixing pins of the lid to the toilet, transverse fixing rod, driving rod, protection cabinet, return spring fixing rod, return spring, return spring fixing device, articulated touching device, two pedals, support for umbrella or cleaning brush, and toilet paper support, the main purpose of which is to avoid the use of the hands in lifting and returning the seat and the toilet lid, therefore preventing all kinds of contamination . . . .

4.3 COMPARISON BETWEEN THE PRIOR ART FOUND AND THE OBJECT OF THE CLAIM

Regarding the analysis of the Prior Art documents found, it can be seen that they diverge significantly from the claimed application, where common problems are found in the research carried out, such as: a) the need for intervention in the toilet, by aggregating equipment that must fit perfectly to the design/shape of the existing toilet and, in case this does not occur, it risks creating cracks where the accumulation of bacteria and pathogenic organisms may occur, further increasing the risk of contamination; b) civil work intervention in the facilities, either through the drilling of the floor for fixing the pedals and rods, as well as the toilet itself; c) activation of the systems through the mechanical action of pedals, levers and other means, therefore depending on the physical strength of the user who, in some cases, due to health conditions, age and disabilities, might not have the necessary physical strength to activate the device; d) they are not universally applicable, that is, they do not apply to all existing toilets on the market.

In view of this explicit analysis, we consider that there are no impediments to the granting of the requested privilege and worthy of all the merits provided for and ensured by the Law of Industrial Property.

5 TECHNOLOGICAL BREAKTHROUGH

The submitted ELECTRO-ELECTRONIC DEVICE FOR TOILET LID AUTOMATION features, as the main technological breakthrough, the fact that the activation of the mechanisms occurs without any contact, only when the feet (or other objects, such as canes and other locomotion support devices) approach the detection sensor, activating the lifting/lowering action of the lid and seat. In addition to this superior advantage, the ELECTRO-ELECTRONIC DEVICE FOR TOILET LID AUTOMATION includes the possibility to be installed in any type of seat complying with the Brazilian Standards (NBR's) in force, due to its mobile adjustment system and slender lift arms, thus enabling its use in previously existing facilities without the need to change the toilet or additional hydraulic systems and civil works.

6 DESCRIPTION OF THE DRAWINGS

For a clear view of the parts that make up the ELECTRO-ELECTRONIC DEVICE FOR TOILET LID AUTOMATION, under analysis now and object of this claim, the following illustrative drawings are attached as follows:

FIG. 1: Perspective view of the toilet with the ELECTRO-ELECTRONIC DEVICE FOR TOILET LID AUTOMATION installed (lid/seat lowered)

Figure 2:
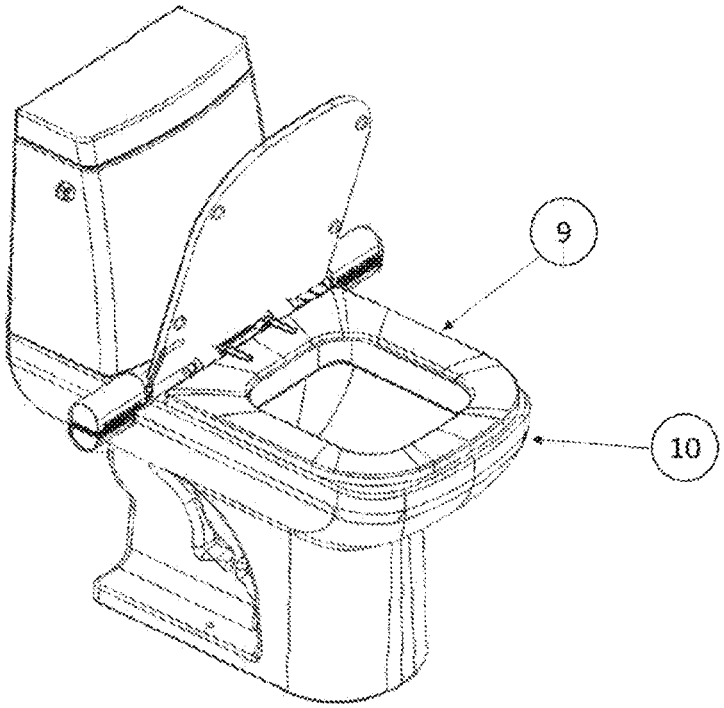
Figure 3:
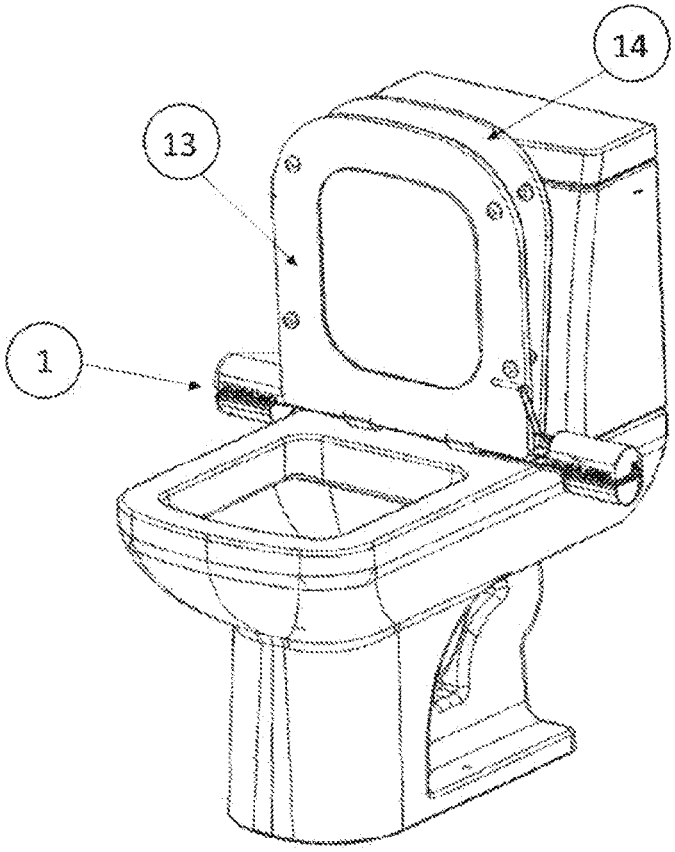
Figure 4:
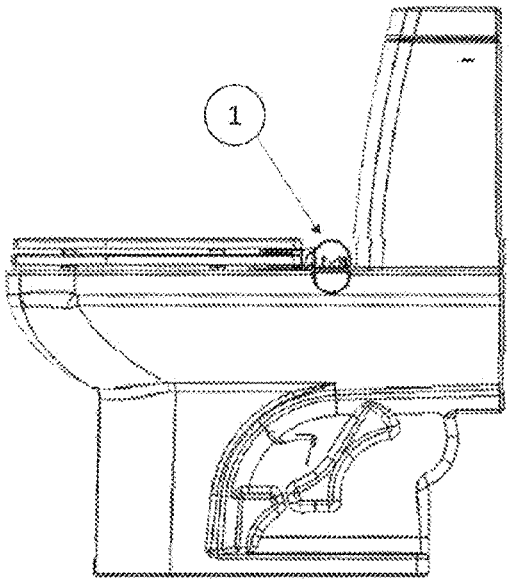
Figure 5:
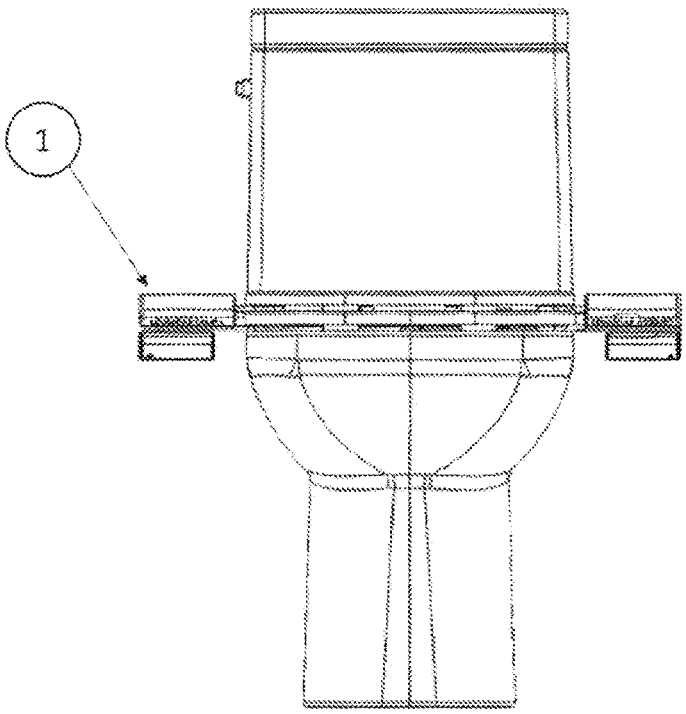
Figure 6:
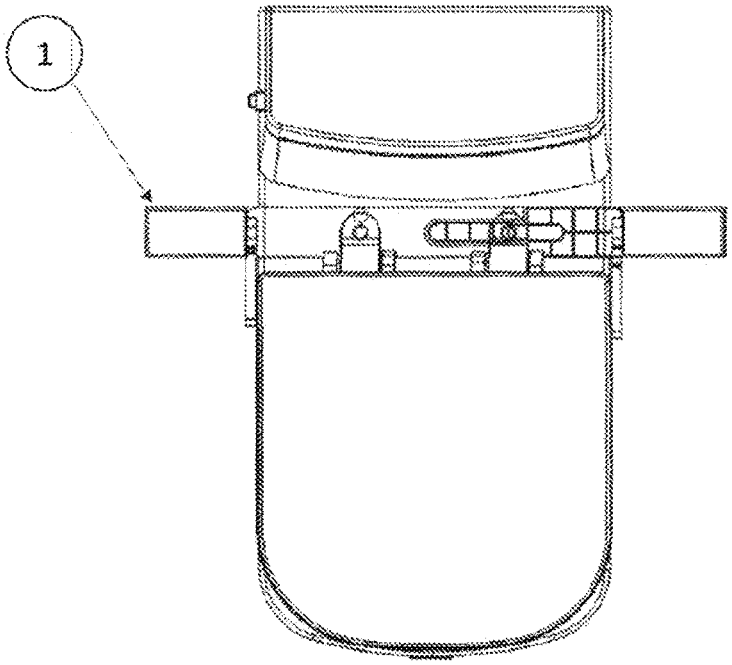
Figure 7:
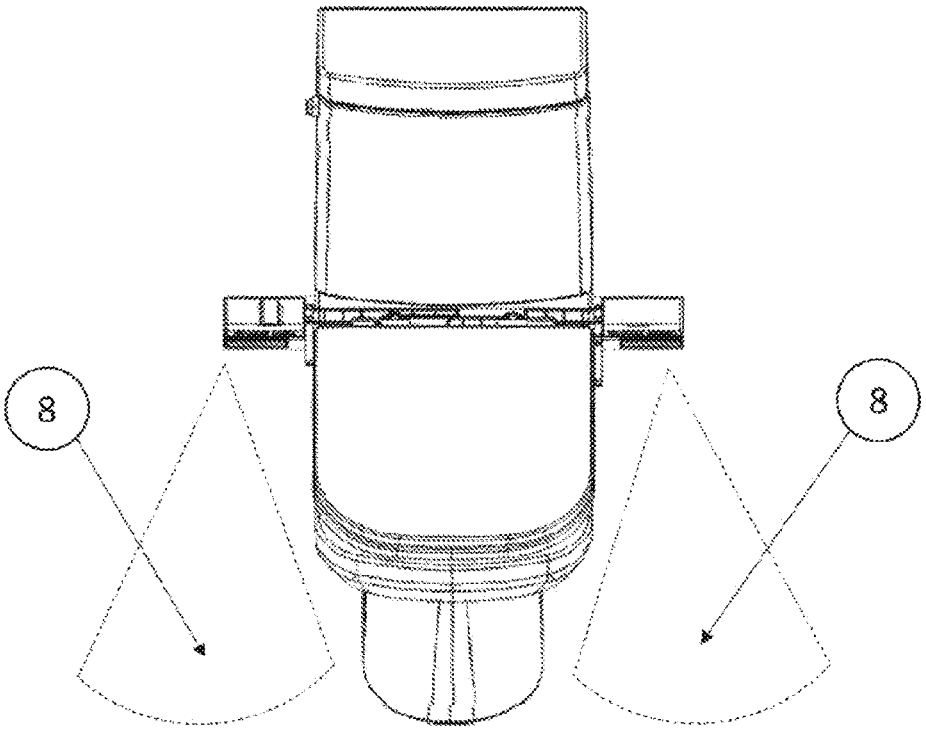
Figure 8:
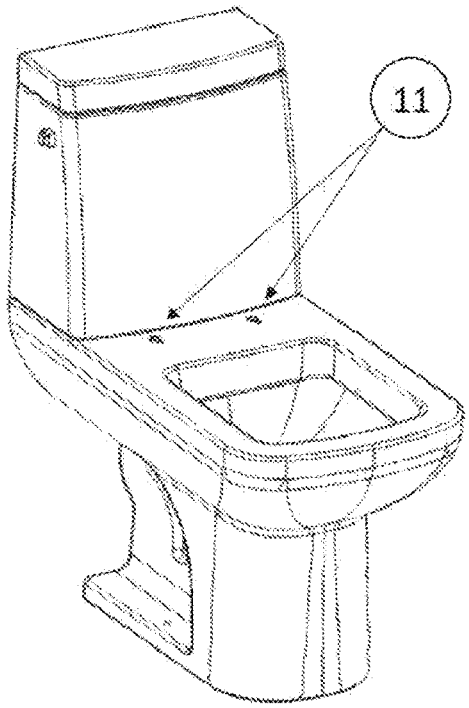
Figure 9:
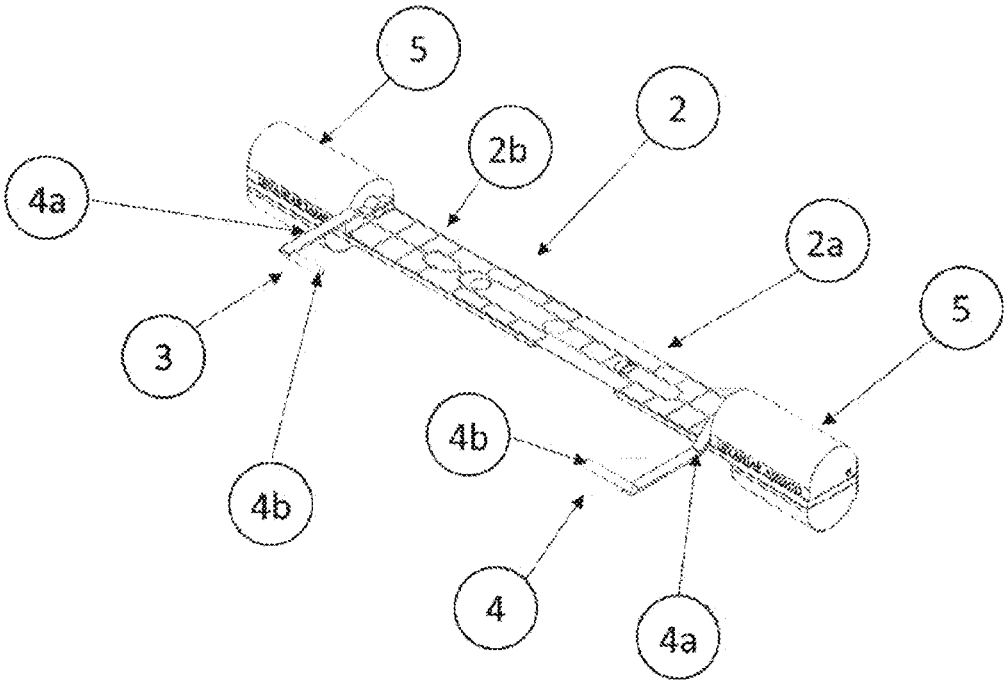
Figure 10:
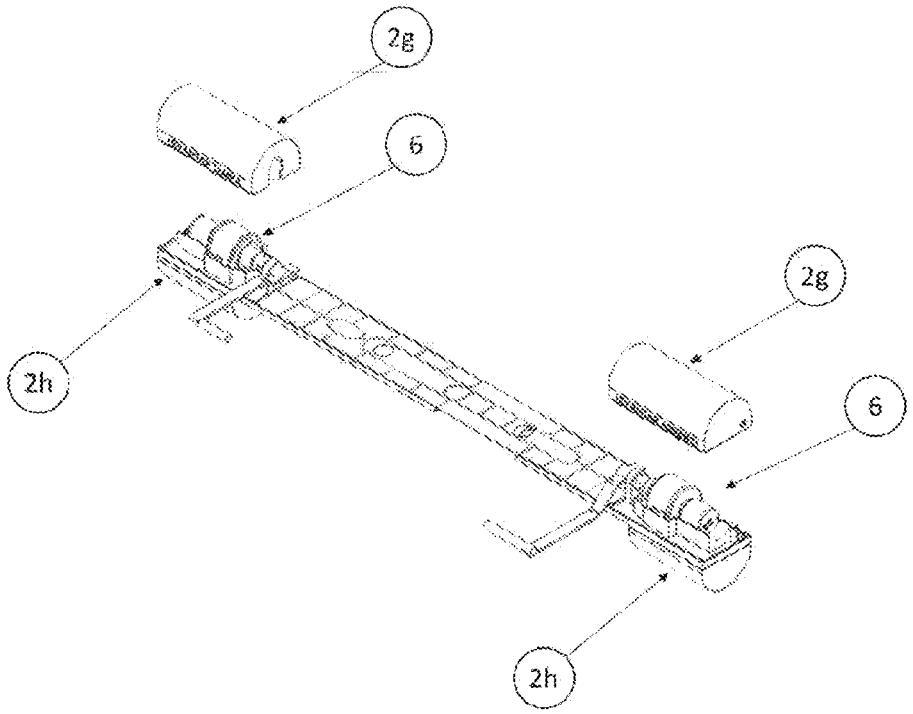
Figure 11:
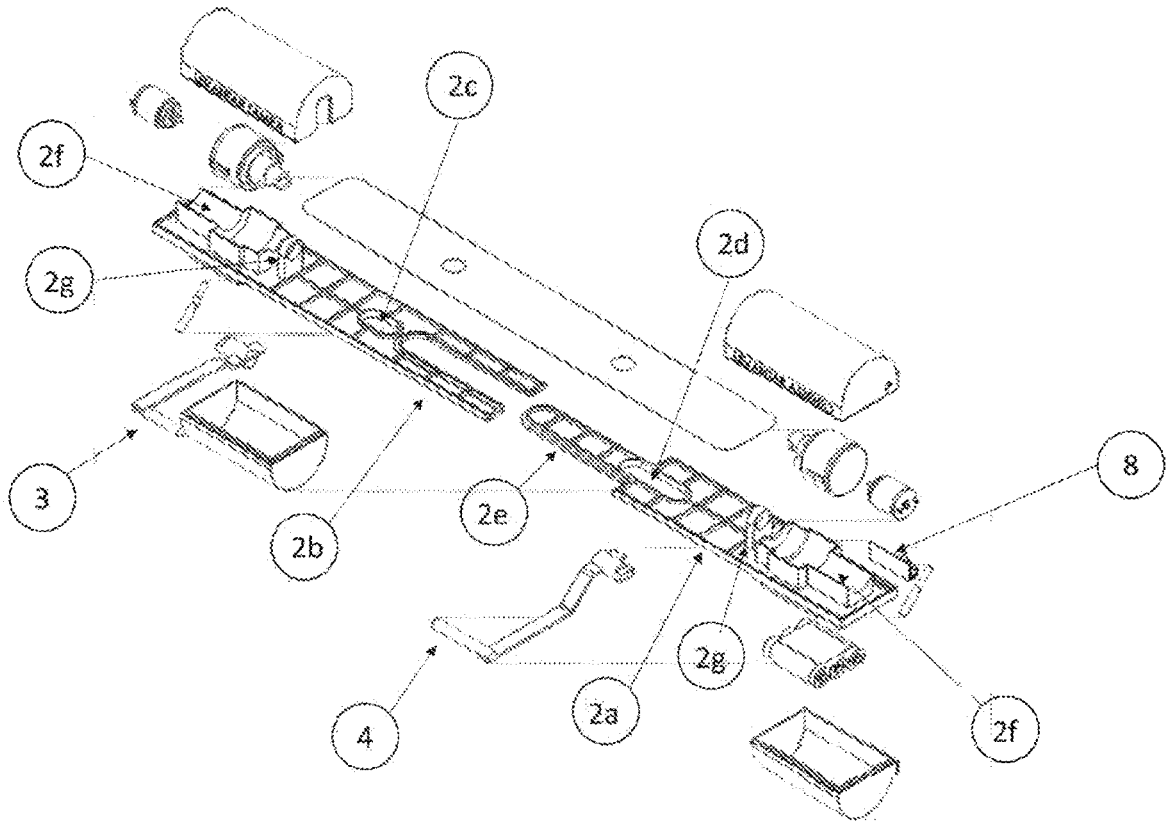
Figure 12:
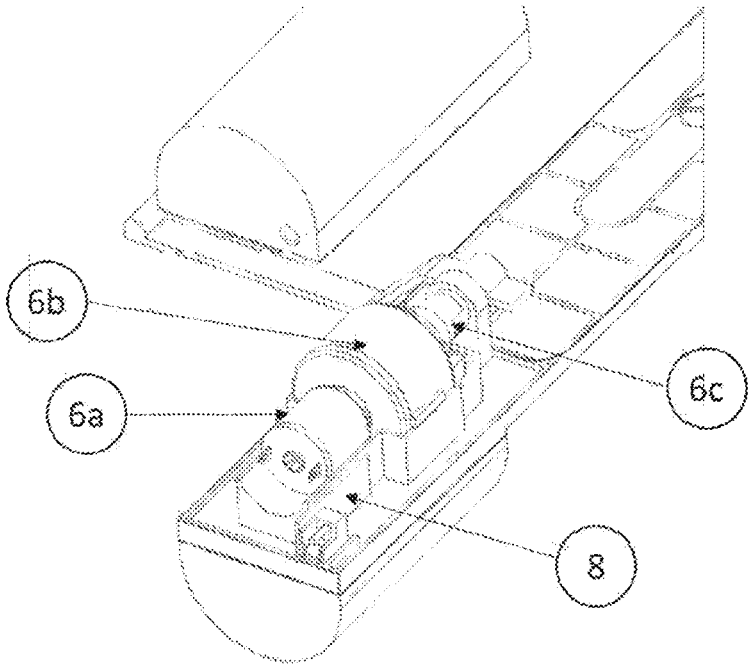

FIG. 2: Perspective view of the toilet with the ELECTRO-ELECTRONIC DEVICE FOR TOILET LID AUTOMATION installed—lid lifted FIG. 3: Perspective view of the toilet with the ELECTRO-ELECTRONIC DEVICE FOR TOILET LID AUTOMATION installed—lid and seat in the lifted position FIG. 4: Side view of the toilet with the ELECTRO-ELECTRONIC DEVICE FOR TOILET LID AUTOMATION installed FIG. 5: Front view of the toilet with the ELECTRO-ELECTRONIC DEVICE FOR TOILET LID AUTOMATION installed FIG. 6: Upper view of the toilet with the ELECTRO-ELECTRONIC DEVICE FOR TOILET LID AUTOMATION installed FIG. 7: Front view of the field of action of the sensors of the ELECTRO-ELECTRONIC DEVICE FOR TOILET LID AUTOMATION identifying the activation FIG. 8: Perspective view of the toilet showing the arrangement of existing holes for universal fixation of the ELECTRO-ELECTRONIC DEVICE FOR TOILET LID AUTOMATION FIG. 9: Perspective view of the ELECTRO-ELECTRONIC DEVICE FOR TOILET LID AUTOMATION FIG. 10: Perspective view of the ELECTRO-ELECTRONIC DEVICE FOR TOILET LID AUTOMATION with upper lids open, showing the arrangement of the gear motor assemblies and the arrangement of the drive arms FIG. 11: Exploded view of the ELECTRO-ELECTRONIC DEVICE FOR TOILET LID AUTOMATION showing all assemblies and sub-assemblies FIG. 12: Sectional view of the ELECTRO-ELECTRONIC DEVICE FOR TOILET LID AUTOMATION showing the gear motor assembly, electric motor, reduction system and shaft protection flange.

Figure 13:
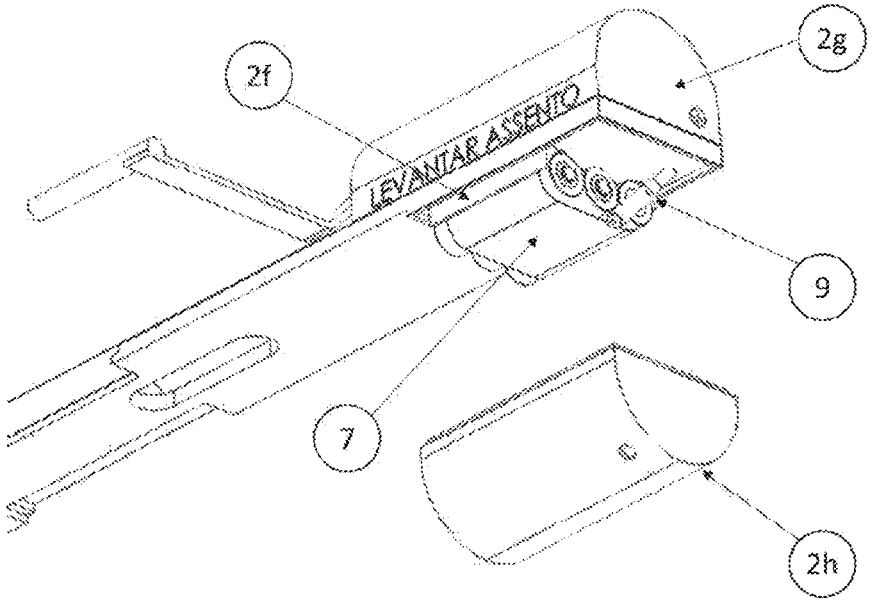

FIG. 13: Sectional view of the ELECTRO-ELECTRONIC DEVICE FOR TOILET LID AUTOMATION showing the rechargeable battery pack and presence sensors.

Figure 14:
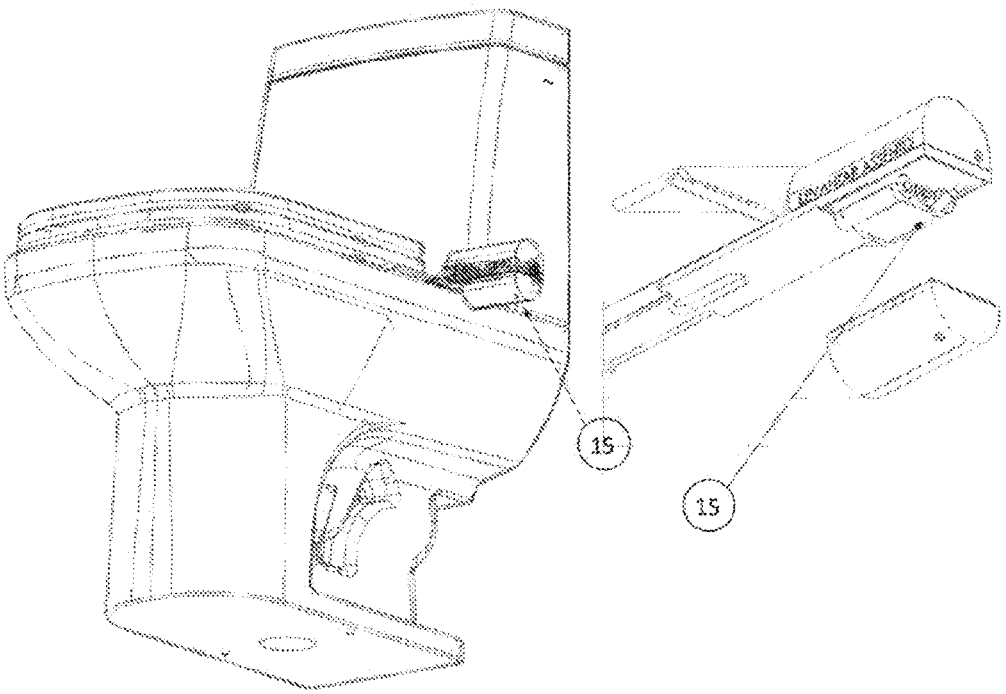

FIG. 14: Bottom view of the ELECTRO-ELECTRONIC DEVICE FOR TOILET LID AUTOMATION showing the arrangement of the sensor and battery.

Figure 15:
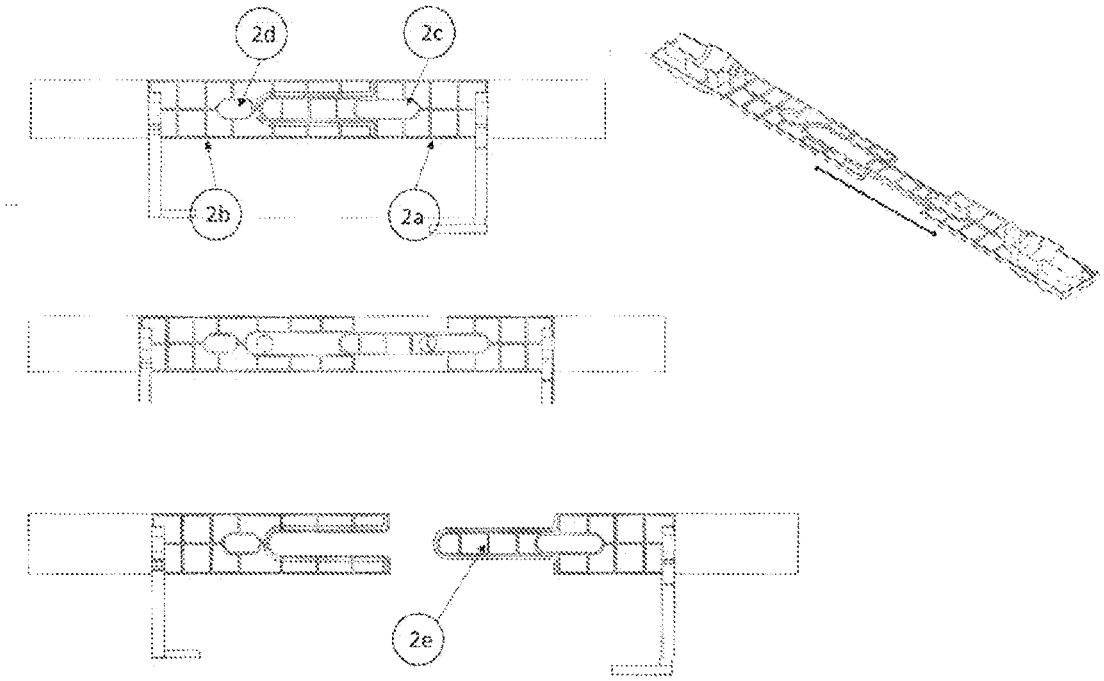

FIG. 15: Shows the drive system of the adjustable fixing base of the ELECTRO-ELECTRONIC DEVICE FOR TOILET LID AUTOMATION

7. MODEL DESCRIPTION

In accordance with the drawings that are part of this report, the ELECTRO-ELECTRONIC DEVICE FOR TOILET LID AUTOMATION (1) was designed for the purpose of inhibiting contamination caused by the handling of the lids and seats of toilets and, to achieve this, it uses electronic and electromechanical driving technology without any kind of physical contact between the user and the toilet.

For this, the ELECTRO-ELECTRONIC DEVICE FOR TOILET LID AUTOMATION uses an assembly to be coupled between the seat (13) and the toilet (10), using the same pre-existing fixing systems (11). The ELECTRO-ELECTRONIC DEVICE FOR TOILET LID AUTOMATION consists of an adjustable fixing base (2); a cover drive arm (3) and a seat drive arm (13); an arm drive assembly (5) composed of an electric motor and a gear motor assembly (6), and two rechargeable batteries (7), an electronic control board (8), and a presence sensor module for the driving process (9).

The main purpose of the ELECTRO-ELECTRONIC DEVICE FOR TOILET LID AUTOMATION is to prevent any type of physical contact of the users hands with the seat (13) and cover (14) of the toilet, using the proximity sensor (15) installed under each gear motor assembly (6) that detects the presence of any object using ultrasound and/or infrared technology and, by means of electronic control, it activates the gear motor assembly (6), either to activate the lid drive arm (3) or to activate the seat drive arm (13), depending on the side where the presence of an object was detected (activation caused by the users foot or by a locomotion support device).

The mechanical design of the ELECTRO-ELECTRONIC DEVICE FOR TOILET LID AUTOMATION includes the possibility to install it in any type of seat manufactured in accordance with the standards NBR 15097 (ceramic material toilet appliance) and NBR 15099 (ceramic material toilet appliances—standard dimensions), by using adjustable supports (2*a* and 2*b*) that are properly fixed through the adjustment of the supports (2*a*) and (2*b*), fixing correctly to the toilet regardless of the type of seat.

8 MATERIALS AND CONSTRUCTION SYSTEMS

The ELECTRO-ELECTRONIC DEVICE FOR TOILET LID AUTOMATION consists of a parallelepiped adjustable fixing base (2) with oblong sides with respective oblong holes (2*c* and 2*d*) for the adjustment of the fixing means of the toilet, as well as it serves as a sliding guide between the adjustable bases (2*e*).

Each support includes the base for the gear motor assembly (2*f*) as well as the upper cover (2*g*) of the drive arm support (3). The gear motor assembly is composed of an electric motor (6*a*) operating on direct current supplied by the rechargeable battery pack (7) and a set of reducing plastic gears (satellite-type gear motor) (6*b*) directly coupled to the shaft of the electric motor. In order to provide the necessary protection to the satellite gear set and the motor itself, the drive shaft has an elastomer flange (6*c*) that absorbs the mechanical shocks of the lifting and lowering of the lid and seat, as well as performing mechanical safety in case the lid gets locked (accidentally or on purpose). In addition, the system has a protection delivered by the program of the control board (8) that interrupts the operation of the motor in case both the lid and the seat get locked, canceling the last reading performed and awaiting new communication from the proximity sensor (9).

The power supply of the electric motor (6), is installed below the fixing base of the rechargeable battery pack (7) to drive the gear motor assembly and its respective control board (8), together with the proximity sensor module (9), all arranged in their respective fittings specially built for this purpose on the adjustable base (2*f*).

To perform the movement of the seat and lid, the ELECTRO-ELECTRONIC DEVICE FOR VESSEL LID AUTOMATION has a lid drive arm (3) and a seat drive arm (13), both have an elongated parallelepiped shape in the torque application region (4*a*) and they have a cylindrical shape in the seat and vessel drive region (4*b*), thus providing the perfect spin of the drive region of the toilet lid and seat. In order to cover and give protection to the moving and electronic parts, the assembly is provided with the upper (2*g*) and lower covers (2*h*), in a half-cylinder shape, each one of them providing a compact assembly and with the proper protection against moisture, dust and chemicals found in toilet environments, in addition to having between the fittings of its lids a nitrile rubber ring that provides the perfect seal (IP64 protection grade), not allowing the entry of moisture or contaminants in the gear motor assembly (6), battery (7), sensor (9) and control board (8).

9 INSTALLATION AND OPERATION

The operation of the ELECTRO-ELECTRONIC DEVICE FOR TOILET LID AUTOMATION—object of this application—is based on sensing without any type of user contact with any moving or fixed part of the toilet or any additional element to it, which makes it significantly different from existing solutions, as well as when considering its flexibility of use. It can be installed in any toilet seat assembly complying with NBR 15097 (ceramic material toilet appliance) and NBR 15099 (ceramic material toilet appliances—standard dimensions).

The installation of the ELECTRO-ELECTRONIC DEVICE FOR TOILET LID AUTOMATION in the toilet is simple and intuitive, if at the time of installation of the lid/seat assembly, the ELECTRO-ELECTRONIC DEVICE FOR TOILET LID AUTOMATION is incorporated between the assembly and the toilet.

After installation, connection and charging of the rechargeable batteries (7) the ELECTRO-ELECTRONIC DEVICE FOR TOILET LID AUTOMATION is ready to be used, simply by approaching the foot or any object of locomotion support in the vicinity of the right or left sensors (9) so that it activates the respective gear motor assemblies (6) and performs the movement of the lid (14) and seat (13). In order to return to the closed position, a new approach to the sensor (9) is sufficient and it will perform a new activation of the gear motor assembly (6) to take the seat and lid (14) to the closed position.

The invention claimed is:

1. An ELECTRO-ELECTRONIC DEVICE FOR TOILET LID AUTOMATION, configured to prevent physical contact of a user with a lid (14) and a seat (13) of a toilet to avoid contamination, the device being coupleable to the toilet using pre-existing holes (11) for fixing the lid and the seat and being applicable to toilets, the device being activated by a proximity of the user's foot or locomotion support object, the device comprising:

an adjustable fixing base, including adjustable supports;

a gear motor assembly (6) mounted to the adjustable fixing base;

drive arms operatively connected to the gear motor assembly, the drive arms including a torque application region and a drive region (4*b*);

rechargeable batteries electrically connected to the gear motor assembly;

upper covers and lower covers (2*h*) enclosing portions of the adjustable fixing base (2) and the gear motor assembly (6), wherein the adjustable fixing base is adjustable such that the upper covers and lower covers enclosing the gear motor assembly are positioned on opposite sides of the lid and the seat with the drive arms extending out and inward towards the center of the lid and the seat to fit under respective ones of the lid and the seat;

supports and bearings for mounting the gear assembly and the drive arms to the adjustable fixing base;

a control board operatively connected to the gear motor assembly; and proximity sensors operatively connected to the control board (8) and configured to activate the gear motor assembly (6) upon detection of proximity, wherein the proximity sensors are positioned on opposite sides of the lid and the seat oriented in the direction of the lid and the seat.

2. A device for automatically lifting and lowering a toilet lid and seat without requiring manual contact, the device comprising:

an adjustable base configured to be mounted to a toilet bowl using existing mounting holes for the lid and seat;

first and second motor assemblies mounted to respective portions of the adjustable base;

first and second drive arms operatively connected to the first and second motor assemblies, respectively, and configured to engage the toilet lid and seat;

covers enclosing the first and second motor assemblies; and at least one proximity sensor operatively connected to the motor assemblies and configured to activate the motor assemblies upon detecting proximity of a user's foot or locomotion support object;

wherein the adjustable base is adjustable in width to position the covers enclosing the first and second motor assemblies on opposite lateral sides of the toilet lid and seat, with the first and second drive arms extending laterally inward toward a center of the toilet lid and seat to fit underneath respective ones of the toilet lid and seat.

3. The device of claim 2, wherein the adjustable base comprises first and second adjustable supports configured to slide relative to each other along a sliding guide to adjust the width.

4. The device of claim 3, wherein the adjustable base includes oblong holes configured for alignment with the existing mounting holes of the toilet bowl.

5. The device of claim 2, wherein each of the first and second motor assemblies comprises an electric motor, a set of reducing gears coupled to the electric motor, and an elastomer flange on a drive shaft to absorb mechanical shocks.

6. The device of claim 5, wherein the set of reducing gears comprises satellite-type plastic gears.

7. The device of claim 2, further comprising rechargeable batteries electrically connected to the first and second motor assemblies and positioned below the adjustable base.

8. The device of claim 2, further comprising an electronic control board operatively connected to the first and second motor assemblies and the at least one proximity sensor, the control board configured to interrupt operation of the motor assemblies if the toilet lid or seat becomes locked.

9. The device of claim 2, wherein the at least one proximity sensor comprises a pair of proximity sensors, each positioned under a respective one of the first and second motor assemblies and configured to detect presence using ultrasound or infrared technology.

10. The device of claim 2, wherein the covers comprise upper covers and lower covers having a half-cylinder shape, the upper and lower covers enclosing the first and second motor assemblies and including a nitrile rubber ring therebetween to provide a seal.

11. The device of claim 2, wherein each of the first and second drive arms has an elongated parallelepiped shape in a torque application region proximate to the respective motor assembly and a cylindrical shape in a drive region configured to engage the toilet lid or seat.

12. The device of claim 11, wherein the cylindrical shape of the drive region is configured to provide rotational engagement underneath the toilet lid or seat, enabling lifting and lowering without direct user contact.

* * * * *